US007997719B2

(12) United States Patent
Rosenzweig et al.

(10) Patent No.: US 7,997,719 B2
(45) Date of Patent: Aug. 16, 2011

(54) MULTI-NOZZLE LIQUID DROPLET EJECTING HEAD, A WRITING INSTRUMENT COMPRISING SUCH A HEAD, AND A METHOD OF EJECTING LIQUID DROPLETS FROM SAME

(75) Inventors: Alain Rosenzweig, Saint Maur des Fosses (FR); Kurt Rath, Herblay (FR); Colin Brooks, Wokingham (GB); Andy Hills, Shepperton (GB)

(73) Assignee: Societe BIC, Clichy (FR)

( * ) Notice: Subject to any disclaimer, the term of this patent is extended or adjusted under 35 U.S.C. 154(b) by 578 days.

(21) Appl. No.: 12/066,350

(22) PCT Filed: Sep. 14, 2005

(86) PCT No.: PCT/EP2005/010062

§ 371 (c)(1), (2), (4) Date: Mar. 10, 2008

(87) PCT Pub. No.: WO2007/031108

PCT Pub. Date: Mar. 22, 2007

(65) Prior Publication Data

US 2008/0204517 A1 Aug. 28, 2008

(51) Int. Cl.
*B41J 3/36* (2006.01)

(52) U.S. Cl. ..... 347/109

(58) Field of Classification Search ..... 347/109
See application file for complete search history.

(56) References Cited

U.S. PATENT DOCUMENTS

| | | | | |
|---|---|---|---|---|
| 4,468,679 | A * | 8/1984 | Suga et al. | 347/10 |
| 5,686,949 | A * | 11/1997 | Swanson et al. | 347/87 |
| 6,474,773 | B1 * | 11/2002 | Silverbrook et al. | 347/29 |
| 6,550,997 | B1 | 4/2003 | King et al. | |
| 7,322,662 | B2 * | 1/2008 | Bich et al. | 347/8 |

FOREIGN PATENT DOCUMENTS

| | | |
|---|---|---|
| EP | 0 775 583 A | 5/1997 |
| EP | 0 895 864 A | 2/1999 |
| EP | 1219431 | 7/2002 |
| WO | WO 2005/037562 A | 4/2005 |

* cited by examiner

*Primary Examiner* — Uyen-Chau N Le
*Assistant Examiner* — Hoang Tran
(74) *Attorney, Agent, or Firm* — Jones Day

(57) ABSTRACT

A liquid droplet ejecting head designed to be mounted in a liquid ejecting instrument that includes ejection nozzles through which droplets are to be ejected from the head, and actuating chambers, each actuating chamber having at least one inlet to be in fluidic connection with a liquid reservoir for providing liquid to the actuating chamber. The ejecting head also includes at least one actuating unit suitable for creating a pulse wave in the liquid contained when activated by energy received from a control device and at least one outlet portion in fluidic connection with at least one ejection nozzle.

15 Claims, 4 Drawing Sheets

MULTI-NOZZLE LIQUID DROPLET EJECTING HEAD, A WRITING INSTRUMENT COMPRISING SUCH A HEAD, AND A METHOD OF EJECTING LIQUID DROPLETS FROM SAME

CROSS-REFERENCE OF RELATED APPLICATION

This application is a national stage application of International Application No. PCT/EP2005/010062, filed on Sep. 14, 2005, the entire contents of which are incorporated herein by reference.

FIELD OF INVENTION

The embodiments of the present invention relate to liquid droplet ejecting heads, and to liquid droplet ejecting instruments comprising such heads. More particularly, the embodiments of the present invention also relate to methods of ejecting liquid droplets from such liquid droplet ejecting heads.

BACKGROUND OF INVENTION

More particularly, the embodiments of the present invention relate to a liquid droplet ejecting head designed to be mounted in a liquid ejecting instrument, comprising a plurality of ejection nozzles through which droplets are to be ejected from the head, and a plurality of actuating chambers, each actuating chamber having at least one inlet to be in fluidic connection with a liquid reservoir for providing liquid to the actuating chamber, at least one actuating means suitable for creating a pulse wave in the liquid contained therein when activated by energy received from a control device, and at least one outlet portion in fluidic connection with at least one ejection nozzle of said plurality of ejection nozzles.

Prior art is known describing ink ejecting heads containing a plurality of actuating chambers having one nozzle of ejection for each ink-ejecting actuators, and the nozzles being arranged in a matrix pattern. A plurality of droplets originating from a plurality of nozzles are then ejected, with each ejected droplet impinging individually onto a support to create a spaced-apart contact area in the same form as the matrix pattern.

These ejecting heads are generally used in a protected environment where drafts of air are minimal, ejecting distances are known and generally stay constant, for example in desk printers. In cases where it has been provided for variable scan speed prior art have generally relied on varying the frequency of ejection to achieve more ink deposition. However, this does not resolve the problem that they still face of ejecting over greater distances.

SUMMARY OF THE INVENTION

The embodiments of the present invention have been conceived in consideration of the above mentioned drawbacks and proposes an alternate solution. Thus an object of the embodiments of the present invention is to provide a liquid droplet ejecting device suitable notably for ejecting droplets from an ejecting head onto a support at greater distance than what conventional devices operate with. To this end an aspect of the embodiments of the present invention is to provide a liquid droplet ejecting head of the above mentioned type characterised in that the plurality of nozzles are arranged such that the ejected droplets combine at a predetermined point situated at a certain distance away from the head.

The head retains a classic actuator arrangement, except that the final droplet is a result of the combination of a plurality of ejected droplets from a number of nozzles. The plurality of ejected droplets can combine anywhere in the gap existing between the head and the support, or even combine at the point of contact with the support. Bigger, and therefore heavier, droplets will be ejected, and they will travel further and truer than smaller droplets. This is an important advantage when using hand-held writing instruments where distances between the liquid droplet ejecting head and the writing surface are generally far larger than applications where traditional ink ejection technology is used, such as desk inkjet printers.

A further advantage of this configuration is that by combining a plurality of simultaneous droplets together on or before the support, a bigger single spot is formed thereon, i.e. without blanks visible between the individual droplets, as can be the case with traditional ejectors. This enables us to draw a thicker line, or to operate the head at a lower ejecting frequency.

It should also be noted that this embodiment of the present invention allows for the use of typically-sized actuators, such as those used in desktop inkjet printers, to create bigger-than-typical sized drops by combining many small ejected droplets into bigger final droplets. Because of the smaller actuator size, this allows for greater positioning and arranging freedom of the actuators within a liquid droplet ejecting head.

A supplementary advantage is the possibility to vary the volume of the final ejected droplets as a function of user-input or deduced outcome by having the option of actuating a different number of actuators at each ink firing, and have a single drop of varying size contact a support. This is especially useful to mark lines of varying thickness without having to vary frequency.

All the while, the structural arrangement remains as in classical devices, whereby the path of ink is very direct from the reservoir to the nozzle, for greater reliability.

DESCRIPTION OF THE PREFERRED EMBODIMENTS

Various embodiments of the embodiments of the present invention may additionally include any one of the following provisions:

- each nozzle of the plurality of nozzles has an ejection axis, and wherein the plurality of nozzles are oriented such that their ejection axis intersect one another at the predetermined point;
- the plurality of actuating chambers are arranged in a substantially radial pattern around a central axis, the predetermined point being located on said central axis;
- a plurality of liquid feed chambers are provided, each feed chamber communicating with the inlet of one actuating chamber and having at least one through-hole to be in fluidic connection with a liquid reservoir;
- the head is substantially flat shaped with a front face and a rear face, parallel to each other, the nozzles being formed in the front face, and holes in communication with the inlets of the actuating chambers being provided on the rear face;
- the inlets and outlet portions of the plurality of actuating chambers extend globally in the main plane of the flat body, and preferentially along radial directions from a central axis;
- the liquid ejecting head is manufactured out of a silicon wafer or formed of a thermoplastic material;

actuating means comprises one of the following means chosen in the group including: electrostatic, thermal, piezoelectric actuating means, and preferably an electrostatic means.

An ejecting head as defined above is particularly suitable to be used in a hand held liquid ejecting instrument having a substantially tubular body with an opening at a front end and containing a liquid reservoir, an energy storage means, a control unit and a liquid droplet ejecting head according to any one of the previous provisions.

The hand held liquid ejecting instrument may also further comprise:

a distance sensing means to determine the distance between said head and a support and designed to eject the liquid on said support when said distance is in a predetermined range;

the predetermined point is situated at a distance to the head such that the liquid droplets ejected simultaneously from the nozzles combine on said support to form a single spot;

the predetermined point is situated at a distance to the head such that the liquid droplets ejected simultaneously from the nozzles combine to form a single drop before impacting said support;

the liquid ejecting instrument is a writing instrument.

The embodiments of the present invention concern a droplets ejecting method for controlling the ejection of droplets by the liquid ejecting head mounted in a liquid ejecting instrument characterised in that it comprises the following steps:

providing a plurality of actuating chambers, each actuating chamber having at least one inlet (107), at least one actuating means suitable for creating a pulse wave in the liquid contained therein, and at least one outlet portion, providing a plurality of ejection nozzles in fluidic connection with outlet portions of said plurality of actuating chambers, feeding the actuating chambers through their inlet with liquid provided from a liquid reservoir, actuating simultaneously the actuating means of at least two actuating chambers of said plurality of actuating chambers by a supply of energy from a control unit in a manner such that at least two liquid droplets are ejected through at least two of said plurality of ejection nozzles, providing an arrangement of said nozzles such that said at least two liquid droplets combine at a predetermined point situated at a certain distance away from the head.

In another preferred embodiment, the invention may also additionally include any one of the following steps:

the simultaneously actuated chambers are chosen among said plurality such that the droplets are ejected from nozzles which are arranged equidistant and in equiangular position with respect to the predetermined point;

the method further comprises a step of determining a number of actuating chambers to be actuated, before the actuating step, to obtain a final determined droplet size.

the instrument is a hand held writing instrument comprising distance and/or movement sensing means, wherein the liquid is an ink, and wherein the method further comprises the steps of:

determining a writing condition from the signals sensed by sensing means;

ejecting ink droplets repeatedly while a writing condition is determined, and preferably at constant ejection frequency;

evaluating the final determined droplet size according to a least one of the parameters of the group including a sensed scan speed of the instrument, a sensed distance between a surface and the ejection nozzle, and a desired thickness or style of the line to be drawn.

DESCRIPTION OF THE DRAWINGS

Other, non-limitative, characteristics and advantages will appear to those skilled in the art in the following detailed descriptions, in which:

On each of the figures, the same reference numerals refer to identical or similar elements.

FIG. 1 represents a particular embodiment of a liquid droplet ejecting head 100 mounted in a non-contact writing instrument 1. However, this embodiment of the present invention is not limited to writing instruments, and it would be apparent to those skilled in the art that this is but one possible embodiment that has equally valid uses in handheld printers, desktop printers, correction devices, painting devices or other instruments which releases liquid onto a support without physical contact between the instrument and the support.

Figure 1:
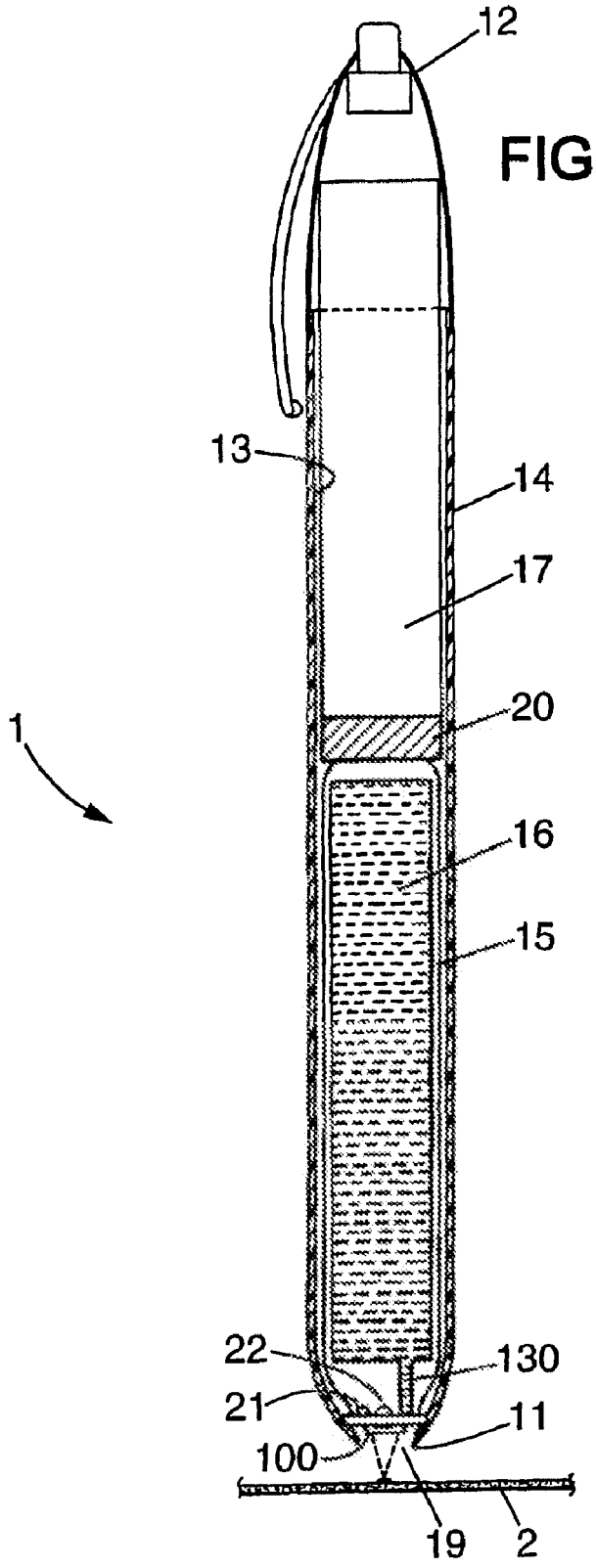
FIG. 1 is a sectional representation of a writing instrument comprising an ejection head according to a first embodiment.

The writing instrument has a substantially tubular element that extends between a front end 11 and a rear end 12 forming a pen. The tubular element has an inside wall 13 defining a hollow internal space, and an outside wall 14 designed to be held in the hand of a user.

The interior hollow space of the writing instrument 1 comprises a liquid reservoir 15 mounted in a removable fashion such that it may easily be end-user replaceable, and contains a liquid 16. The liquid used in this embodiment presented, that of a writing instrument, will have visible ink as its liquid, but depending on the application, the liquid may also be correcting fluid, glue or other liquids to suit the application.

At least one fluidic link 130 exists between the liquid reservoir 15 and the liquid droplet ejecting head 100.

The writing instrument 1 further comprises an energy storage unit 17 to provide energy to a control unit 20 and a liquid droplet ejecting head 100. The energy storage unit 17 may be mounted in the writing instrument 1 such that is may be easily replaceable, or it may be integrated with the liquid reservoir 15 as described in French patent application filed on Jul. 22, 2004 under the application n° FR 04 08138, or have means on the writing instrument for recharging.

The writing instrument 1 may also comprise other devices such as a means for measuring distance between the liquid ejecting head 100 and a writing medium 2, such as with an optical range finder 21, and means for measuring writing activity of the pen, for example with an accelerometer 22.

According to the first embodiment, the liquid droplet ejecting head 100 is mounted in the writing instrument 1 facing a front opening 19 situated at the frond end 11 of the writing instrument 1. The head is physically small such that it can be located rear to the front end 11 forming the pen tip without causing visual obstruction to the user.

The control unit 20, which comprises a central processing unit, a system clock, and other parts, serves to process all data such as those of distance and writing activity measurements and also to regulate and energize the energy process provided for the actuation of the droplet ejecting head 100 responsible for ejecting liquid 16 out of nozzles 99.

It is also realizable for the control unit 20 to be adapted to only eject liquid 16 out of the liquid droplet ejecting head 100 while movement is detected through the accelerometer 22, and that simultaneously the optical system 21 detects that a distance between the nozzle 99 and the writing medium 2 lies in a range of values defined by a predetermined minimum value and a predetermined maximum value, it may also follow the principle of "ink again unless already marked"—that is to say that the optical system 21 would detect whether the surface has already been marked and will not further mark it.

Figure 4:
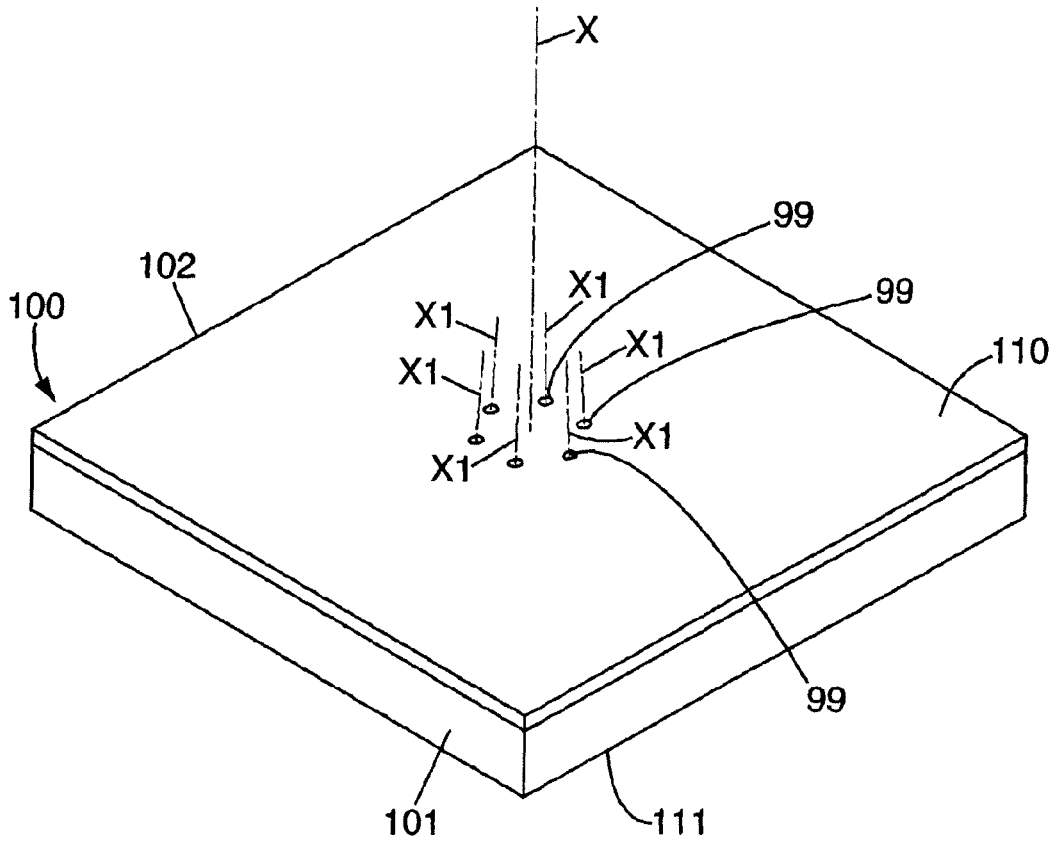
FIG. 4 shows a perspective view of the ejection head comprising a cover plate and a base plate.
Figure 5:
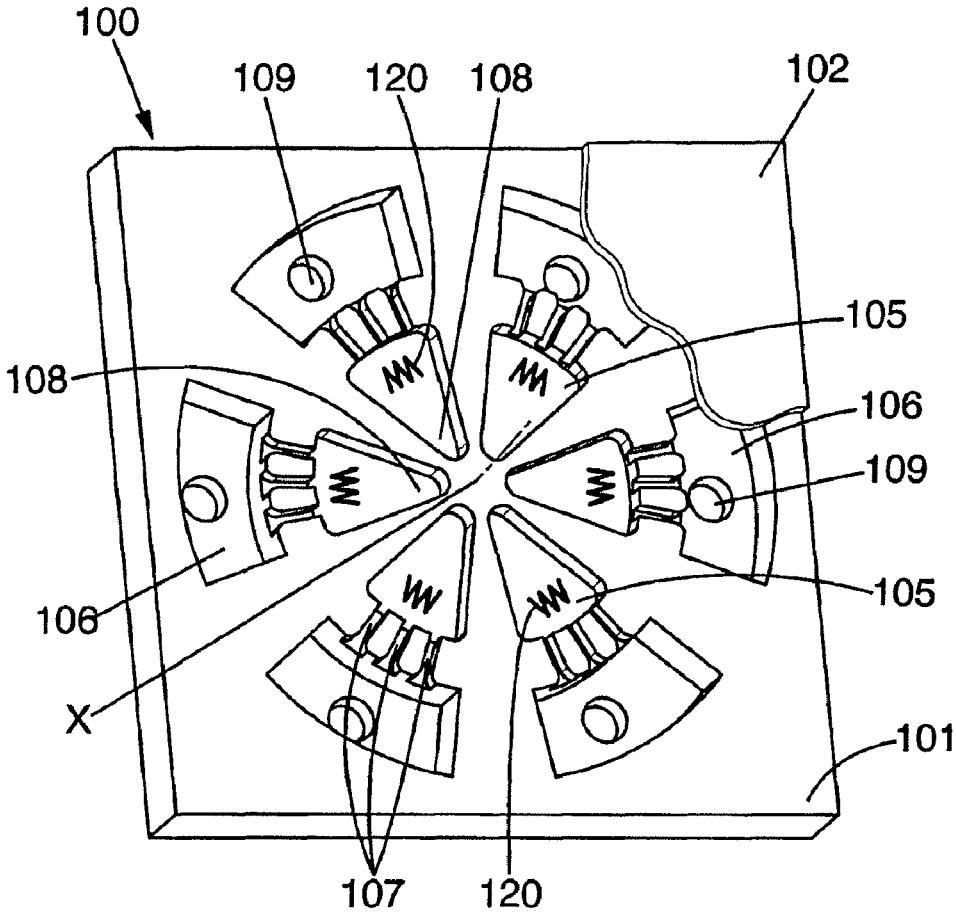
FIG. 5 shows the same perspective view as in FIG. 4, with the cover plate removed.

As best seen on FIGS. 4 and 5, the liquid droplet ejecting head 100 is defined by a base plate 101 on which multiple actuating means 120, also called actuators, for ejecting liquid 16 are provided and a cover plate 102 placed on the top of the base plate 101 to cover the base plate and thus contain the liquid 16 in the chamber contained therein. The head 100 constitutes a front face 110 defined by the top surface of the cover plate 102, and a rear face 111 defined by the bottom surface of the base plate 101.

The base plate 101 and the cover plate 102 are of a substantially flat rectangular shape, and are manufactured by semi-conductor process using a silicon wafer, or similar. However, other materials can be used for manufacturing the base and cover plates (101, 102). In particular, these components of the liquid ejecting head can be formed of a thermoplastic material, like polycarbonate, in order to reduce the cost.

FIG. 5 best shows the base plate 101 with a cut away portion of the cover 102. A plurality of actuating chambers 105 and feeding chambers 106 are provided. As it is the case for this embodiment, three feeding channels 107 establish a fluidic communication between the feeding chamber 106 and the actuating chamber 105 and form the inlets for the actuating chambers 105. The outlet portions 108 of the actuating chambers 105 provide a fluidic communication between the actuating chambers 105 and the ejecting nozzles 99. A different number of channels or different shaped channels 107 are entirely possible, as long as they fulfill the purpose of delivering liquid from the feeding chambers 106, or directly from the ink reservoir 15, to the actuating chambers 105.

Each nozzle 99 is in fluidic communication with one actuating chamber 105 via an outlet portion 108 positioned in the base plate 102. However, it is conceivable to connect two or more nozzles of the plurality of nozzles to one actuating chamber, or one nozzle with two or more actuating chambers.

The actuating chamber 105 comprising the actuation means 120 are linked to the control unit 20 by signal lines (not shown) for energizing and driving the actuation means 120.

Figure 2:
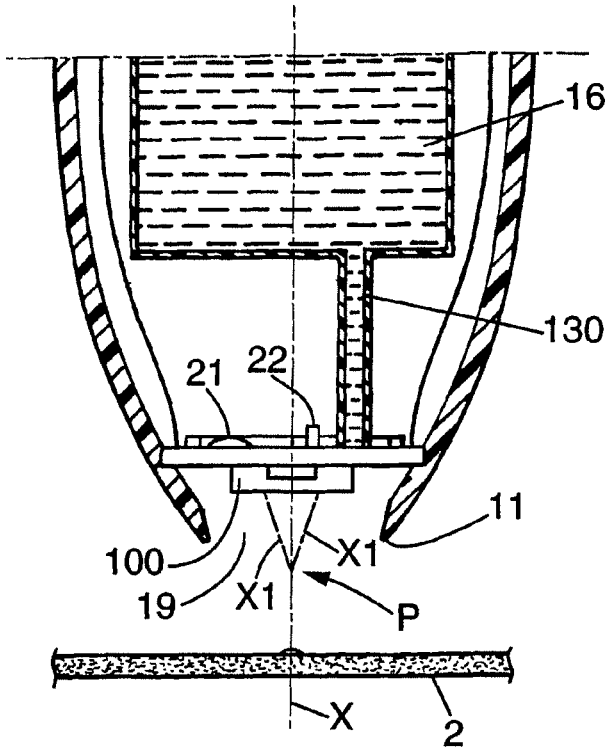
FIG. 2 is a more detailed view of the embodiment in FIG. 1, wherein the ejected droplets combine at a point situated before the support.
Figure 3:
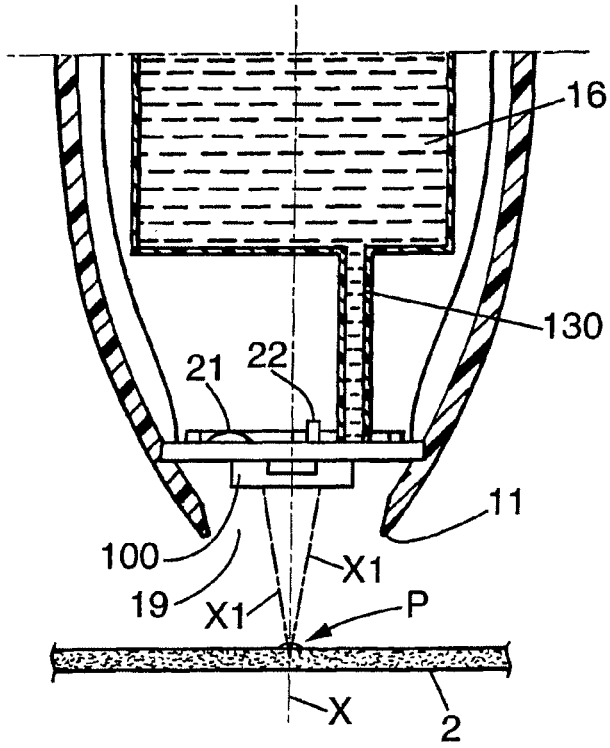
FIG. 3 is the same view as in FIG. 2 of a second embodiment, wherein the ejected droplets combine at a point situated on the support.

The cover plate 102 is a thin plate in which a central axis X traverses. A plurality of nozzles 99 are positioned on the front face 110 substantially radially and equidistant from this central axis X. Each nozzle 99 of the plurality of nozzles has an ejection axis X1, such that each ejection axis of the plurality of nozzles 99 intersects one another at a predetermined point P. Point P is at a predetermined distance between the ejection head 100 and the support 2. FIGS. 2 and 3 illustrate two different cases whereby the droplets combine before the support (FIG. 2), and on the support (FIG. 3). Point P is thus the point where the plurality of ejected droplets emanating from the plurality of nozzles 99 combine and continue on to impact the surface 2 and mark a single spot. The term "combine" refers to a plurality of droplets coming together and continuing in unison. The ejected droplets may join to touch each other and continue on a slightly altered trajectory together. Alternatively, they may physically combine to form a single homogenous drop.

As it is showed on FIG. 5, six actuating chambers 105 are singularly connected to six liquid feed chambers 106 and are arranged around a central axis X in a radial pattern.

Each actuating chamber 105 is substantially sector shaped, however it can be in any shape accommodating the actuating means 120 and providing an outlet portion 108 in fluidic communication with at least one nozzle 99 formed in the cover plate 102. The actuating chambers 105 and the feeding chambers 106 are equidistant from the centre, and equiangular from each other, and extend globally on the same plane of the base plate 101. The nozzles 99 are also arranged symmetrically and equiangularly around the central axis X. Consequently, the ink drop resulting from the combined droplets at point P travels along the central axis X and impact the support 2 with high precision. However, for other reasons, it may be intended to have a deliberate uneven distribution of droplets such that at point P they combine and continue to impact the support 2 at a divergent angle to the central axis X.

Liquid 16 flows through the actuating chambers, toward the outlet portions 108 under energy from pulses emitted by the actuators 120 which are part of the actuating chambers 105. The actuating chambers 105 themselves are supplied with liquid 16 from the liquid feed chambers 106. This embodiment has the form of connecting one-to-one actuating chambers 105 and feeding chambers 106, however it is conceivable to have one liquid feed chamber 106 connecting more than one actuating chamber 105.

The liquid feed chambers 106 are in fluidic communication with the liquid reservoir 15 and temporarily stores a small amount liquid 16, that is allowed to flow from the feed chambers 106 into the actuating chambers 105.

Furthermore, the fluidic connection channels 107 connecting the feed chambers 106 to the actuating chambers 105 are designed in such a way for easing the flow of liquid 16 into the actuating chambers 105 but providing a much great resistance to backward flow and under a pulsed pressure effected by the actuators 120 from the energy provided by the control unit 20. If the outlet portion 108 constitutes a separate portion to the actuating chambers 105, then a passage to the outlet portion should provide as little resistance as possible to the pulsed liquid traversing this part.

An ink supplier hole 109 is located in each liquid feed chamber 106. The liquid supplier hole 109 is perforated through the thickness of the base plate 101 and emerges in the rear face 111 of the base plate, which also constitutes the rear face of the ejecting head 100. The hole 109 communicates with the liquid reservoir 15.

The embodiment described comprised six actuating chambers 105, however any plurality of actuating chambers may be realized with the same concept presented herein.

Actuating chambers 105, and more particularly actuators 120, can be controlled individually, in groups, or all together in parallel. However in practice the actuators 120 are operated in opposite pairs or groups, irrespective of the numbers of chambers present.

In a typical configuration of such a droplet ejecting device 100 as described above, a microscopic droplet pulsed from the actuating chamber 105 typically has a volume in the range 25 to 80 pl, such that the total volume of all chambers is approximately 150-200 pl.

It is important to note that this concept could be implemented using any actuating means, including piezoelectric, thermal, or electrostatic actuators.

The most common means of actuating a liquid pulse is with a thermal head, however it suffers from the disadvantage of limited life. To go some way towards alleviating this problem of limited life, the control unit can be configured to rotate the usage of a specific actuator as a function of previous action to spread the wear evenly across all actuators.

Another actuating means in with piezoelectric actuators. These have the advantage of having no limitations when used together with non water-based liquids. However they suffer in hand-held applications from the high-voltages needed for actuation.

The preferred means of actuation is with an electrostatic actuator due to its high energy efficiency, particularly at small scales. It is not limited also to water based liquids and only low voltages are needed.

A further embodiment possible under this invention is the ability of mixing different liquids, for example the ability of mixing different coloured inks. Instead of having a liquid reservoir 15 containing a single colour, one could conceivably separate the reservoir into different containers for different colours, but not necessarily in equal volumes to take into account different weighing factors or usage rates. A plurality of feeding channels 130 could then be made into the support 110 of the liquid ejecting head such that only a subset of the total number of actuator is responsible for each colour. With this embodiment, and using four separate colours comprising cyan, magenta, yellow and black, it is conceivable that the user could write in any colour, from a combination of the above colours.

Next, a method of ejecting a liquid droplet from the liquid droplet ejecting heads 100 according to the embodiments will be described.

As mentioned above, the ejecting head 100 is mounted on the end of a writing instrument 1 for a particular embodiment, and the liquid instrument 1 comprising a control unit 20, an energy source 17 for powering the control unit 20, and a liquid reservoir 15.

The ink is stored in either a fixed or replaceable ink reservoir 15 in the body of the writing instrument 1, and feeds the droplet ejecting head 100 with ink 16 through at least one fluidic communicating channel 130. The liquid feed chamber 106 allows a small individual reserve of ink 16 to be available to its corresponding actuating chamber 105, and the perforated hole 109 provided in said feed chamber 106 communicates with the liquid reservoir 15.

The actuator 120 type in the actuating chamber 105 may comprise, but is not restricted to, the following types: electrostatic, piezoelectric, thermal. This document will not enter into the detailed working of these different types of actuators as they exist in various embodiments, and they are well known in the art.

Once the control unit 20 determines it appropriate, the actuators 120 in the actuating chambers 105 actuates from a pulsed energy input provided by the control unit 20.

This burst of energy would be mostly directed via a path of least resistance which is towards the centre towards the outlet portion 108. A pulsed wave containing a small amount of liquid 16 will then move towards the nozzles 99. This liquid-carrying pulsed wave from the actuating chambers 105 will traverse the base plate 101 along the main plane towards the nozzles 99. The droplets will exit out of the nozzles 99 contained in the cover plate 102, and together with other pulsed droplets effected at the same instant of time from other actuating chambers 105, will combine after ejection from the nozzles 99 at a point P.

It may be desirable to spread the usage of the actuators 120 such that each actuator accumulates, on average, approximately the same number of actuation. This is especially desirable for the thermal-type actuators.

The head 100, and also the control unit 20, must be capable of inking at a sufficiently high frequency such that individual drops of ink are not visible and the ejection appears continuous. The control unit 20 will therefore actuate a varying number of actuators 120 at a fixed frequency of between 500-800 Hz, such as to attain a reasonable drop size on the writing surface so as to attain a reasonable perceived thickness of the written line depending on the scan speed of the instrument 1. A total combined drop volume at point P of approximately 150-200 pL is desirable in order to create a reasonable line width on the writing surface 2, for example 0.3 mm on a single pass.

An advantage of this over having a varying droplet size is that inking frequency can be maintained at a reasonable rate to prevent the individual drops from visibly separating, even if the pen tip moves quickly.

The control unit 20 will determine the number of actuators 120 to actuate to vary line widths as a function of pen scanning speed sourced from internal sensors such as accelerometers 22, or external commands such as pressure on the pen grip, or user settings.

The droplets size could be also determined according to the sensed distance between the nozzle 99 and the medium 2 to guarantee an impact of the droplets against the medium 2. It is also possible to vary the droplets size to vary the thickness of the written line.

We claim:

1. A liquid droplet ejecting head designed to be mounted in a liquid ejecting instrument, comprising a plurality of ejection nozzles through which droplets are to be ejected from the head, and a plurality of actuating chambers, each actuating chamber having at least one inlet to be in fluidic connection with a liquid reservoir for providing liquid to the actuating chamber, at least one actuating means suitable for creating a pulse wave in the liquid contained therein when activated by energy received from a control device, and at least one outlet portion in fluidic connection with at least one ejection nozzle of the plurality of ejection nozzles, wherein each ejection nozzle has an ejection axis, wherein the plurality of ejection nozzles are oriented such that the ejection axis of each nozzle intersects with one another at a predetermined point situated on a central axis of the head at a certain distance away from the head so as each ejection axis forms an angle with the central axis, the ejected droplets combine at the predetermined point, and wherein the control device is configured to actuate the actuating chambers at a fixed frequency between 500-800 Hz, the plurality of actuating chambers being arranged to pulse a total combined drop volume of approximately 150-200 pL.

2. The liquid droplet ejecting head according to claim 1, wherein the plurality of actuating chambers are arranged in a substantially radial pattern around a central axis, the predetermined point being located on the central axis.

3. The liquid droplet ejecting head according to claim 1, wherein a plurality of liquid feed chambers are provided, each feed chamber communicating with the inlet of one actuating chamber and having at least one through-hole to be in fluidic connection with a liquid reservoir.

4. The liquid droplet ejecting head according to claim 1, wherein the head is substantially flat shaped with a front face and a rear face, parallel to each other, the nozzles being formed in the front face, and holes in communication with the inlets of the actuating chambers being provided on the rear face.

5. The liquid droplet ejecting head according to claim 4, wherein the inlets and outlet portions of the plurality of actuating chambers extend globally in the main plane of the flat body, and preferentially along radial directions from a central axis.

6. The liquid droplet ejecting head according to claim 5, wherein the liquid ejecting head is manufactured out of a silicon wafer or formed of a thermoplastic material.

7. The liquid droplet ejecting head according to claim 6, wherein actuating means comprises one of the following means chosen in the group including: electrostatic, thermal, piezoelectric actuating means and an electrostatic means.

8. A hand held liquid ejecting instrument having a substantially tubular body with an opening at a front end and containing a liquid reservoir, an energy storage means, a control unit and a liquid droplet ejecting head according to claim 1, wherein the plurality of ejection nozzles of the ejection head faces out of the front opening of the tubular body.

9. The hand held liquid ejecting instrument according to claim 8, further comprising a distance sensing means to determine the distance between the head and a support and designed to eject the liquid on the support when the distance is in a predetermined range.

10. The hand held liquid ejecting instrument according to claim 9, wherein the predetermined point is situated at a distance to the head such that the liquid droplets ejected simultaneously from the nozzles combine before or on the support to form a single spot.

11. The hand held liquid ejecting instrument according to claim 9, wherein the predetermined point is situated at a distance to the head such that the liquid droplets ejected simultaneously from the nozzles combine to form a single drop before impacting the support.

12. The hand held liquid ejecting instrument according to claim 8, wherein the liquid ejecting instrument is a writing instrument.

13. The liquid droplet head according to claim 1, wherein the plurality of ejection nozzles comprises several ejection nozzles which are arranged equidistant with respect to the predetermined point.

14. The liquid droplet ejecting head according to claim 13, wherein the angles with respect to the central axis of each ejection axis of the several ejection nozzles are identical.

15. The hand held liquid ejecting instrument according to claim 9, wherein the predetermined point is situated at a distance away from the head such that the liquid droplets ejected simultaneously from the nozzles combine before a support being at a distance in the predetermined range.

* * * * *